US008267337B2

(12) United States Patent
Webb

(10) Patent No.: US 8,267,337 B2
(45) Date of Patent: Sep. 18, 2012

(54) PARTICLE REDUCTION DEVICE

(75) Inventor: Donald Barry Webb, Mt. Nathan (AU)

(73) Assignee: Fibrecycle Pty Ltd., Mudgeeraba, Queensland (AU)

( * ) Notice: Subject to any disclaimer, the term of this patent is extended or adjusted under 35 U.S.C. 154(b) by 265 days.

(21) Appl. No.: 12/596,877

(22) PCT Filed: Apr. 22, 2008

(86) PCT No.: PCT/AU2008/000563

§ 371 (c)(1),
(2), (4) Date: Oct. 21, 2009

(87) PCT Pub. No.: WO2008/131477

PCT Pub. Date: Nov. 6, 2008

(65) Prior Publication Data

US 2010/0140384 A1 Jun. 10, 2010

(30) Foreign Application Priority Data

Apr. 27, 2007 (AU) ..... 2007902223

(51) Int. Cl.
*B02C 19/00* (2006.01)
*B02C 13/00* (2006.01)

(52) U.S. Cl. ..... 241/27; 241/154; 241/275

(58) Field of Classification Search ..... 241/27, 241/69, 154, 275
See application file for complete search history.

(56) References Cited

U.S. PATENT DOCUMENTS

| | | | | | |
|---|---|---|---|---|---|
| 744,382 | A | * | 11/1903 | Moor | 241/45 |
| 1,527,818 | A | * | 2/1925 | O'Neill | 241/69 |
| 2,639,747 | A | * | 5/1953 | Burn et al. | 241/89.4 |
| 3,643,879 | A | | 2/1972 | Palyi | |
| 4,151,794 | A | * | 5/1979 | Burkett | 100/74 |
| 4,886,216 | A | * | 12/1989 | Goble | 241/152.1 |
| 5,192,029 | A | * | 3/1993 | Harris | 241/27 |
| 5,685,500 | A | * | 11/1997 | Eide et al. | 241/154 |
| 5,740,971 | A | | 4/1998 | Hsu | |
| 5,797,550 | A | | 8/1998 | Woodall et al. | |
| 6,179,231 | B1 | * | 1/2001 | Csendes | 241/19 |
| 6,227,473 | B1 | * | 5/2001 | Arnold | 241/285.1 |

FOREIGN PATENT DOCUMENTS

| | | |
|---|---|---|
| EP | 0054916 | 6/1982 |
| JP | 58193109 | 11/1983 |

OTHER PUBLICATIONS

International Search Report; International Application No. PCT/AU2008/000563; Dated Jun. 26, 2009.

* cited by examiner

*Primary Examiner* — Faye Francis
(74) *Attorney, Agent, or Firm* — Winston & Strawn LLP

(57) ABSTRACT

A particle reduction device with a housing containing an inlet for receiving paper material into a flow chamber, at least two adjacently spaced particle reduction stages through which paper material flows from one stage to the other for reducing the particle size of the material, and an outlet for outputting processed material with reduced particle size. Each particle reduction stage of the paper particle reduction device includes an impact member that rotates about a central shaft for impacting material into smaller particles. At least one of the stages has a screen, located downstream from the impact member, that includes perforations through which particles of a sufficiently small size can pass.

14 Claims, 8 Drawing Sheets

PARTICLE REDUCTION DEVICE

This application is a 371 National Stage Application of PCT/AU2008/000563, filed Apr. 22, 2008; which claims priority from Australian Application No. 2007902223, filed Apr. 27, 2007.

The present invention relates to a particle reduction device for reducing the particle size of material, for instance cellulous fibrous material.

BACKGROUND OF INVENTION

There are many different kinds of equipment available to reduce the particle size of material, where the equipment selected usually depends on the type of material to be processed and the result to be achieved. Pulverizers are commonly used for reducing particle size of materials and are machines that grind, crush and break up material. Using plates having teeth that are corrugated pulverizers are used in industrial applications to break down material including cellulose, such as paper, grain, brick, shale, concrete, wood, metals and even synthetic materials such as plastics.

Pulverizers are usually used in tandem with other machines as a part of a larger process and particularly as a late stage particle reduction device where larger particles have already been reduced to a size suitable for feeding into pulverizers. For example, in the insulation industry paper is first shredded through a shredder and then introduced into a pulverizer.

Shredders are also used for reducing the particle size output of material to a particle size that is larger than that achieved by pulverizers, which may be desired in certain applications.

The problem with known particle size reduction equipment is that material needs to be processed separately through more than one device in order to reduce the material from a large unprocessed particle size to a small desired final particle size. Known equipment is only designed to reduce particle size by a certain extent that is often less than the entire required reduction in particle size.

It is intended with the present invention to provide a single device capable of meeting the particle size reduction needs that may be required in industry.

SUMMARY OF THE INVENTION

In accordance with the present invention there is provided a particle reduction device comprising:

- a housing containing an inlet for receiving material into a flow chamber, at least two adjacently spaced particle reduction stages through which material flows from one stage to the other for reducing the particle size of the material, and an outlet for outputting processed material with reduced particle size; each particle reduction stage having an impact member that rotates about a central shaft for impacting material into smaller particles;
- wherein at least one of the stages has a screen located downstream from the impact member, the screen having perforations through which particles of a sufficiently small size can pass.

The particle reduction device preferably principally relies on gravitational flow to convey the particles down through the device. For additional flow assistance induced air, for example generated by an externally mounted fan, may assist the flow of particles.

Preferably, the screen is located adjacent and below the at least one particle reduction stage and it is the last stage for reducing particle size that is provided with the perforated screen. At the first stage the impact member is located above a shelf containing one large aperture, the impact member rotating close to the aperture's circumference on the shelf.

There are preferably three particle reduction stages, wherein the second and third stages have perforated screens and the perforations of the third stage are smaller than the perforations of the second stage.

The number and size of perforations in the perforated screens are selected to promote continuous and consistent flow of particles through the device. This is preferably achieved by arranging the perforation size to produce a flow rate through the first screen that is lower than the flow rate through the second screen.

The impact members at the stages associated with perforated screens are preferably elongated beaters fixed to a beater plate that rotates around the central shaft. Each beater plate supports between four to ten beaters and preferably eight beaters.

The impact member at the first stage is preferably a solid rotor set to rotate around the central shaft and having short beaters provided about the circumference the solid rotor.

The housing is preferably an upright, multi-faceted enclosure such that the interior walls defining the flow chamber are multifaceted to promote circulation of particles. Preferably, the housing is at least an octagon in shape.

The inlet is preferably provided at the top of the housing above the first stage, and the outlet is provided at the bottom of the housing below the last stage.

In accordance with a further aspect of the present invention there is provided a method of reducing the particle size of material including:

- introducing material into a particle reduction device comprising at least two adjacently spaced stages for reducing particle size;
- impacting material with an impact member at each stage as the material flows through the device to reduce the material particle size at each stage, and whereby at least one of the stages impacts material until it is of a sufficiently small size to pass through a perforated screen located downstream of the impact member; and
- conveying the material with reduced particle size out of the device.

The material is preferably gravitationally fed through the device or it can be fan assisted. The material preferably flows down through the device and the screen is located below the at least one particle reduction stage.

The method preferably comprises flowing the material through three stages whereby the particle size of the material reduces at each stage and wherein at the last two stages the material is impacted until it is of a sufficient small size to pass through the perforated screens at the last two stages, the perforations of the last screen being smaller than the perforations at the second last screen.

BRIEF DESCRIPTION OF THE DRAWINGS

An embodiment, incorporating all aspects of the invention, will now be described by way of example only with reference to the accompanying drawings in which:

FIG. 5(*b*) is a top sectional view of a second reduction stage;

FIG. 5(*c*) is a top sectional view of a third reduction stage; and

DETAILED DESCRIPTION OF PREFERRED EMBODIMENT

Figure 1:
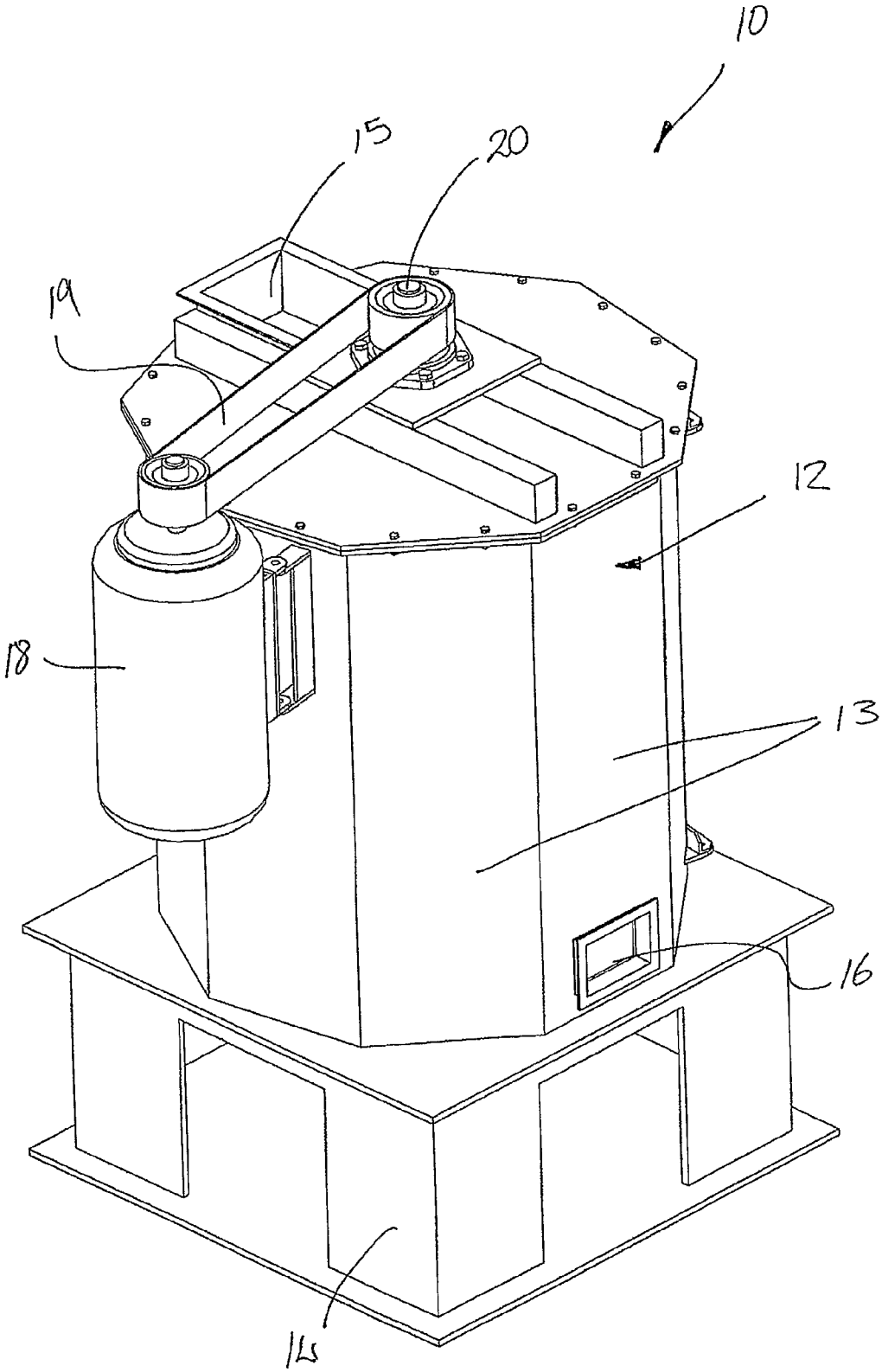
FIG. 1 is a first isometric view of a particle reduction device in accordance with an embodiment of the invention.

A particle reduction device 10 is illustrated in the drawings. The device specifically illustrated is a multi-stage gravitational flow particle reduction device operating as a gyroscopic centrifuge which rapidly and continuously reduces the particle size of material fed into the device through at least two stages to output material having a particle size significantly smaller compared to the size of the material introduced.

Material that may be fed through the device 10 includes any type of material having particles that may be reduced in size by shredding, grinding, beating, crushing, and the like. Some examples include fibrous material such as paper and other cellulose material, wood, grain, plastics and glass. For the purpose of the following description reference will be made largely to paper fibre.

In many circumstances the particle reduction device 10 is able to replace two or more known particle reduction devices usually used in tandem or to at least provide a faster particle reduction process.

Figure 2:
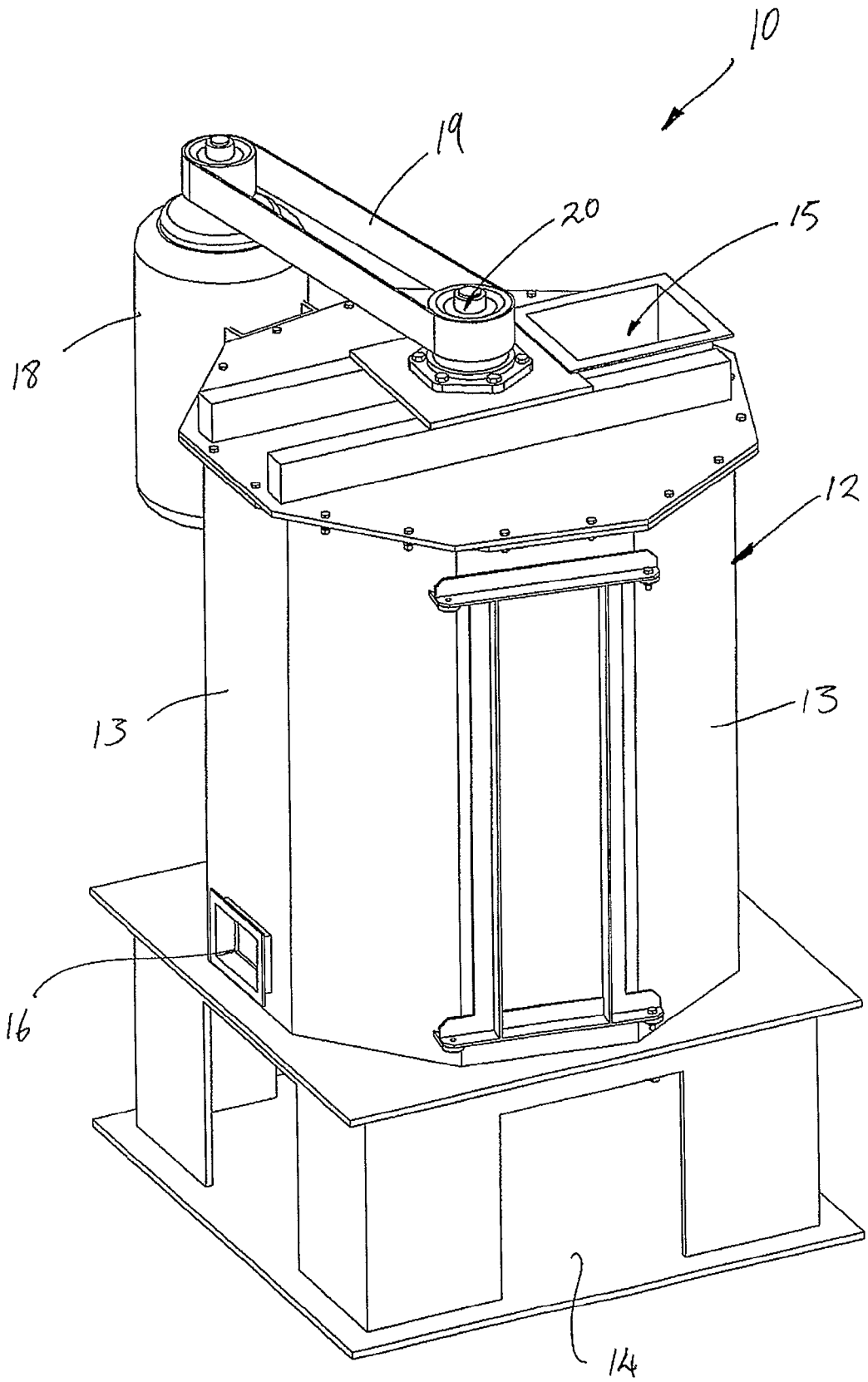
FIG. 2 is a second isometric view of the particle reduction device.

As illustrated in FIGS. 1 and 2, which show the exterior of the device, particle reduction device 10 comprises an enclosed housing 12, the housing having side walls 13 forming a nonagon shaped housing. Housing 12 is supported on base platform 14. A feed inlet 15 at the top of housing 12 receives material to be processed, while processed material exits through an outlet 16 located a lower end of side walls 13. Material is processed in a flow chamber 22 inside the housing 12.

Figure 3:
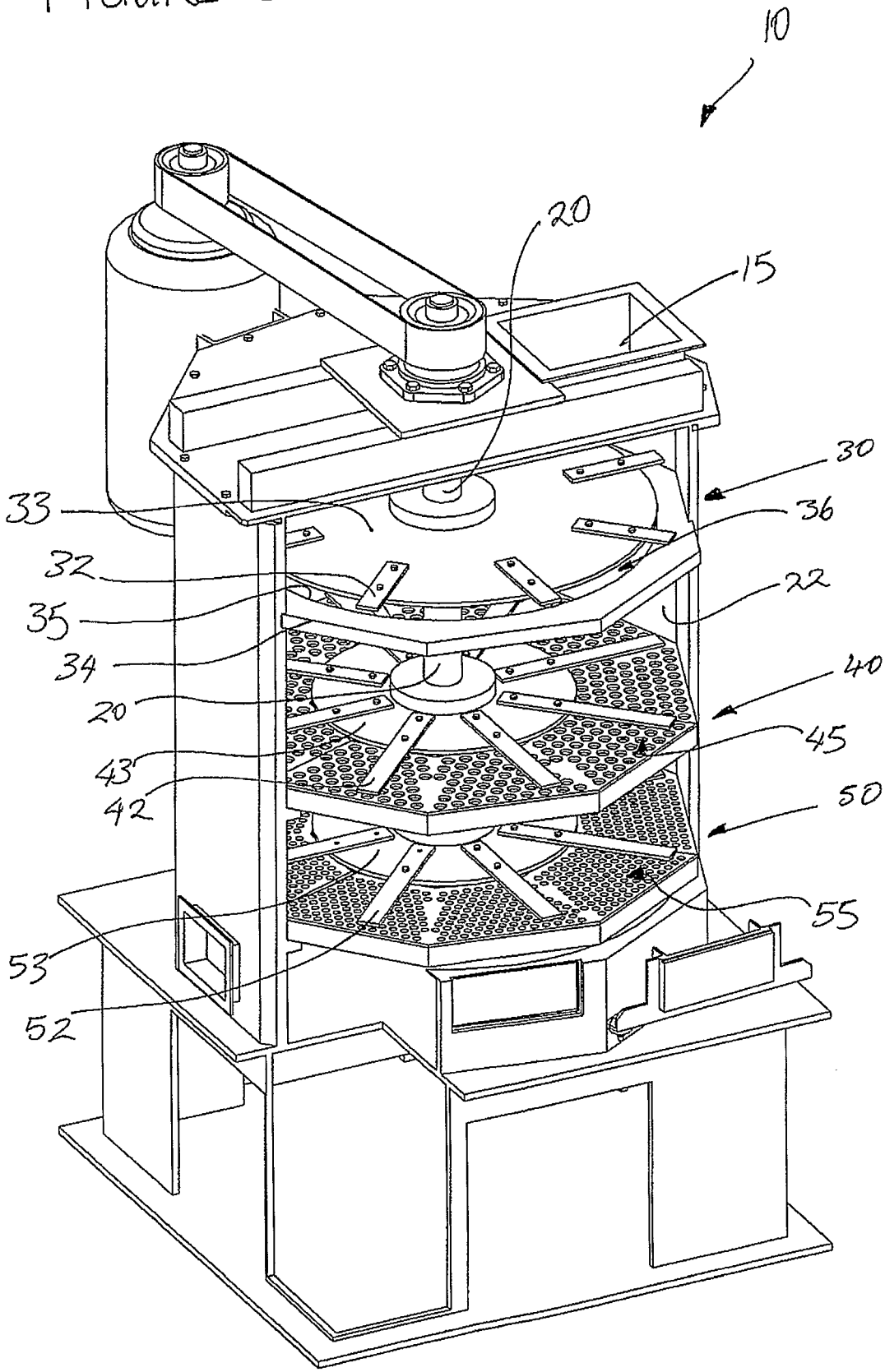
FIG. 3 is a first isometric partially cut-away view of the particle reduction device.
Figure 4:
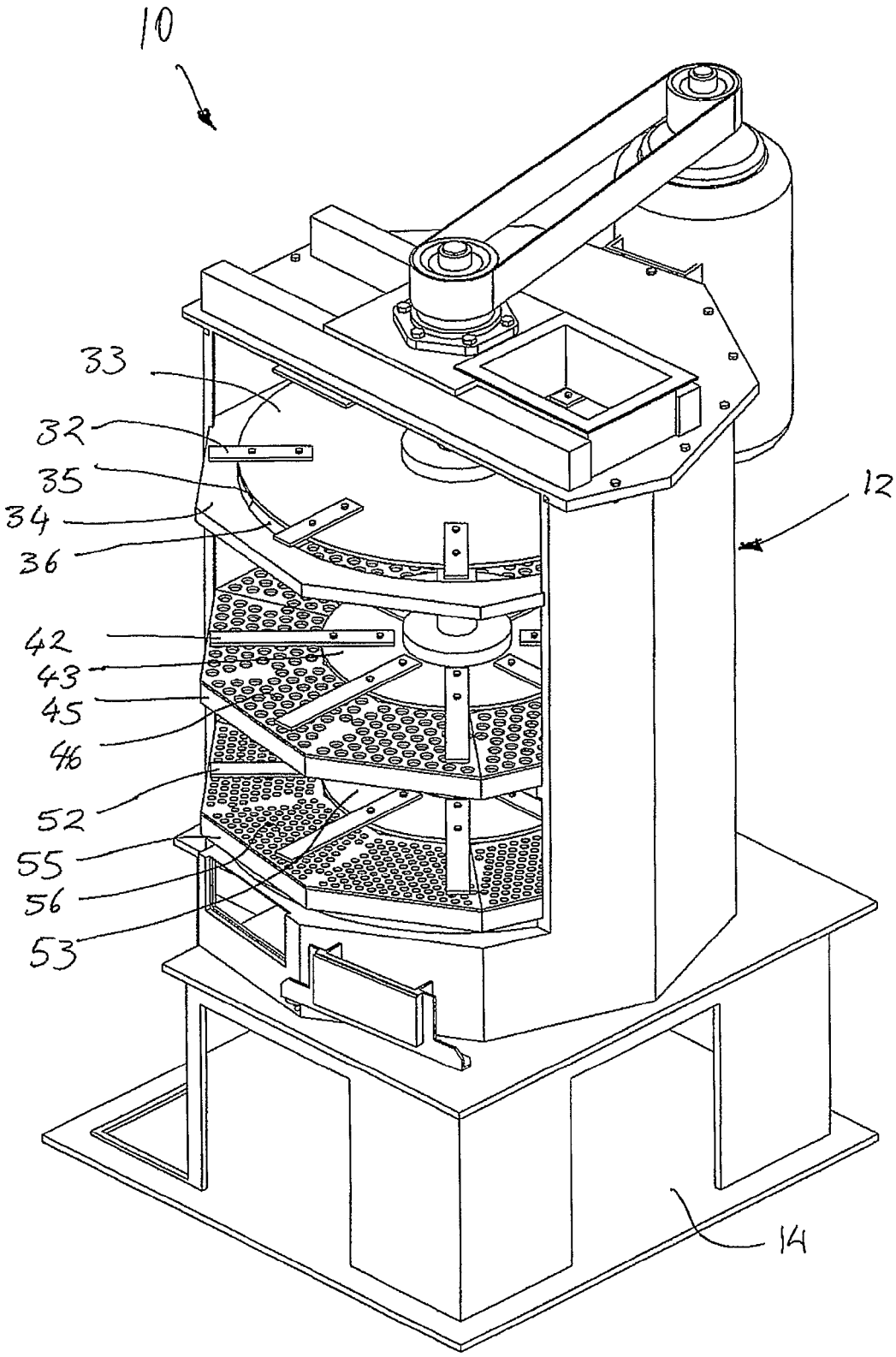
FIG. 4 is a second isometric partially cut-away view of the particle reduction device.

A motor 18 attached to the side of the housing 12 drives, by way of a belt 19, a central shaft 20 vertically positioned through the interior of the housing, as illustrated in FIGS. 3 and 4.

FIGS. 3 and 4 illustrate inside the housing and show a flow chamber 22 having three vertically spaced particle reduction stages 30, 40, 50. Particulate matter introduced into the flow chamber 22 through feed inlet 15 is reduced in size at each stage by way of impacting/grinding the material using beaters or blades having blunt edges. Particulate matter that has been sufficiently reduced in size by one stage passes down the device through to the next stage to be further reduced in size. Once the matter has passed through all stages it exits through outlets 16 with a final reduced particle size.

The particle reduction stages 30, 40, 50 are each defined by a beater assembly and a separation platform. The beater assembly at each stage comprises a number of beaters 32, 42, 52 attached to a beater plate 33, 43, 53 that is mounted onto the central shaft 20 to rotate about shaft 20.

Figure 5A:
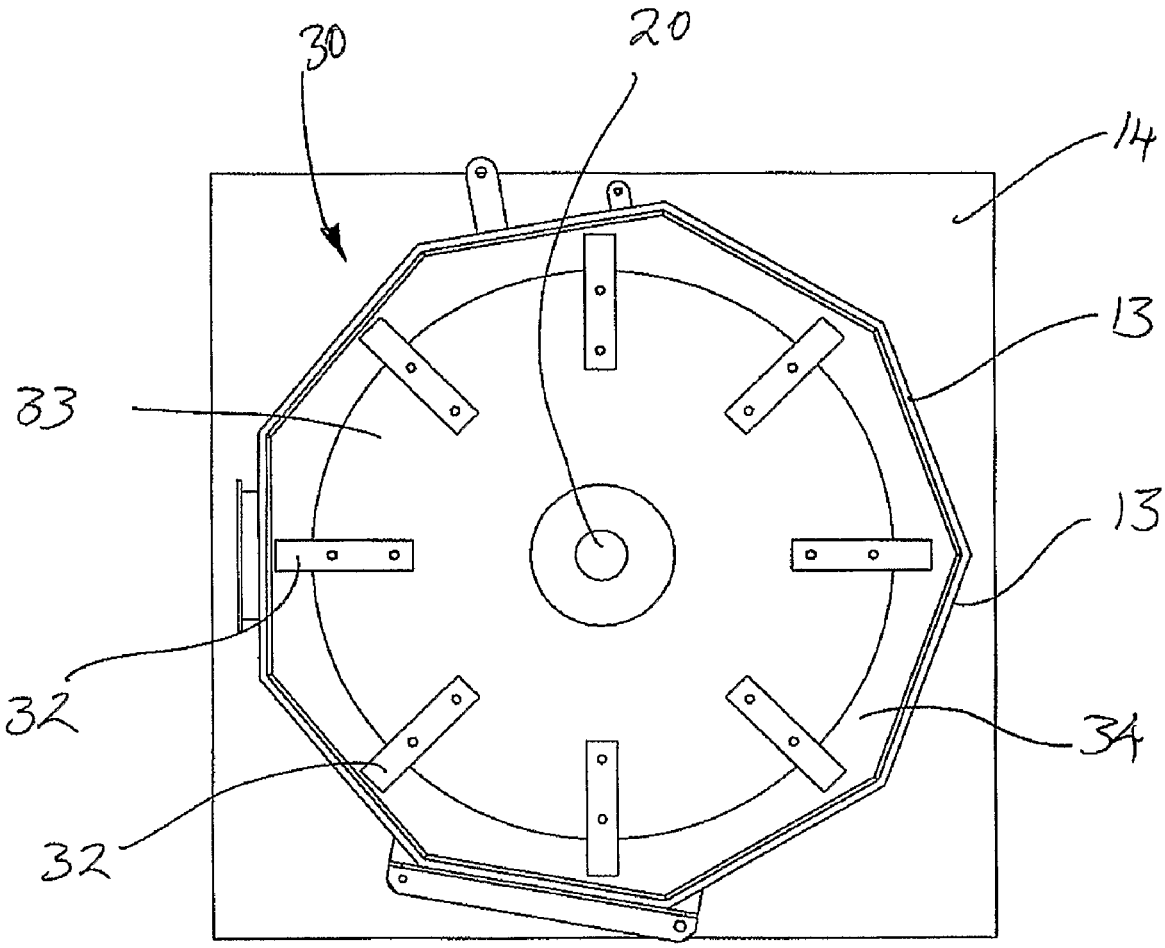
FIG. 5(*a*) is a top sectional view of a first reduction stage.
Figure 5:
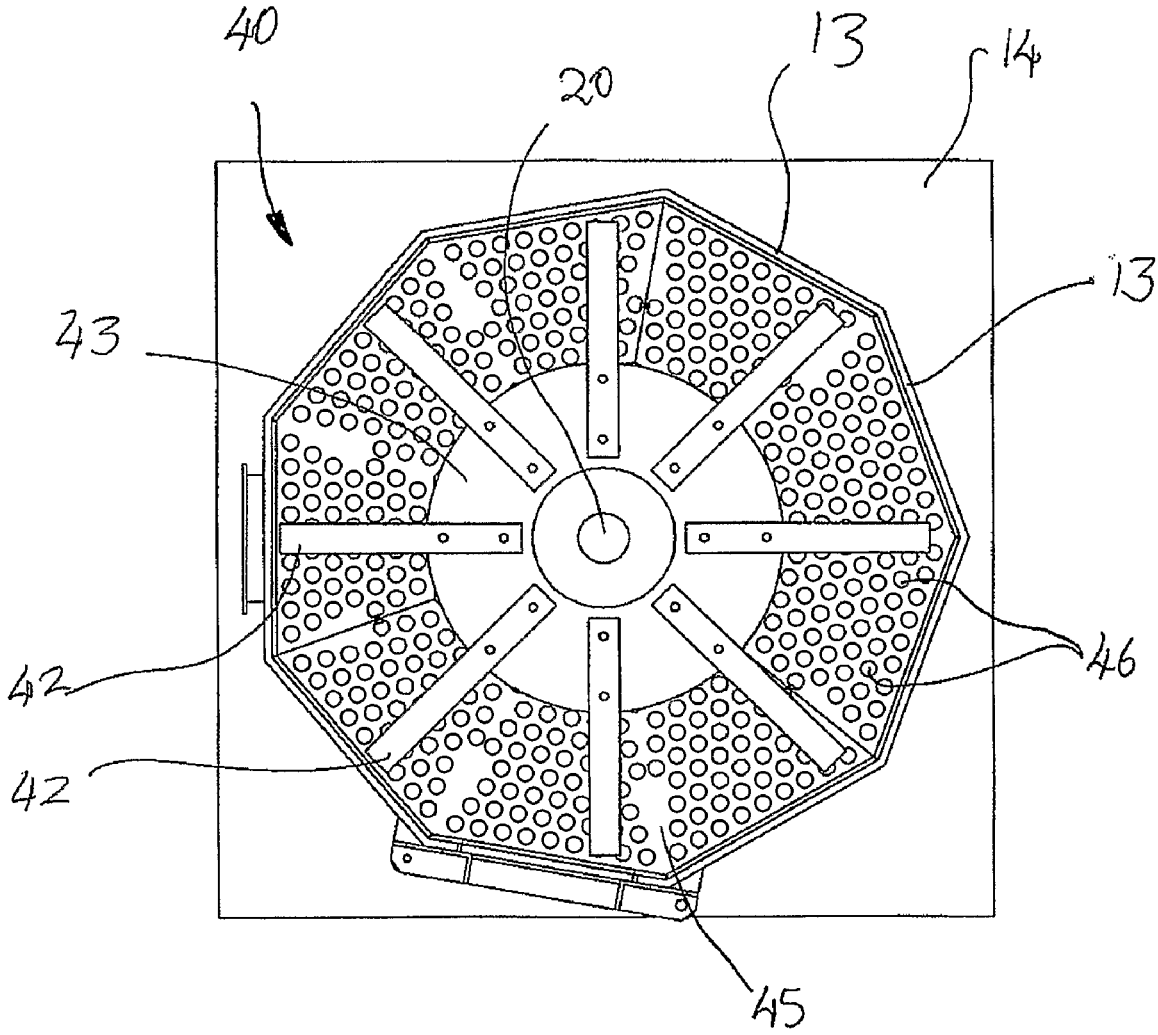
Figure 5C:
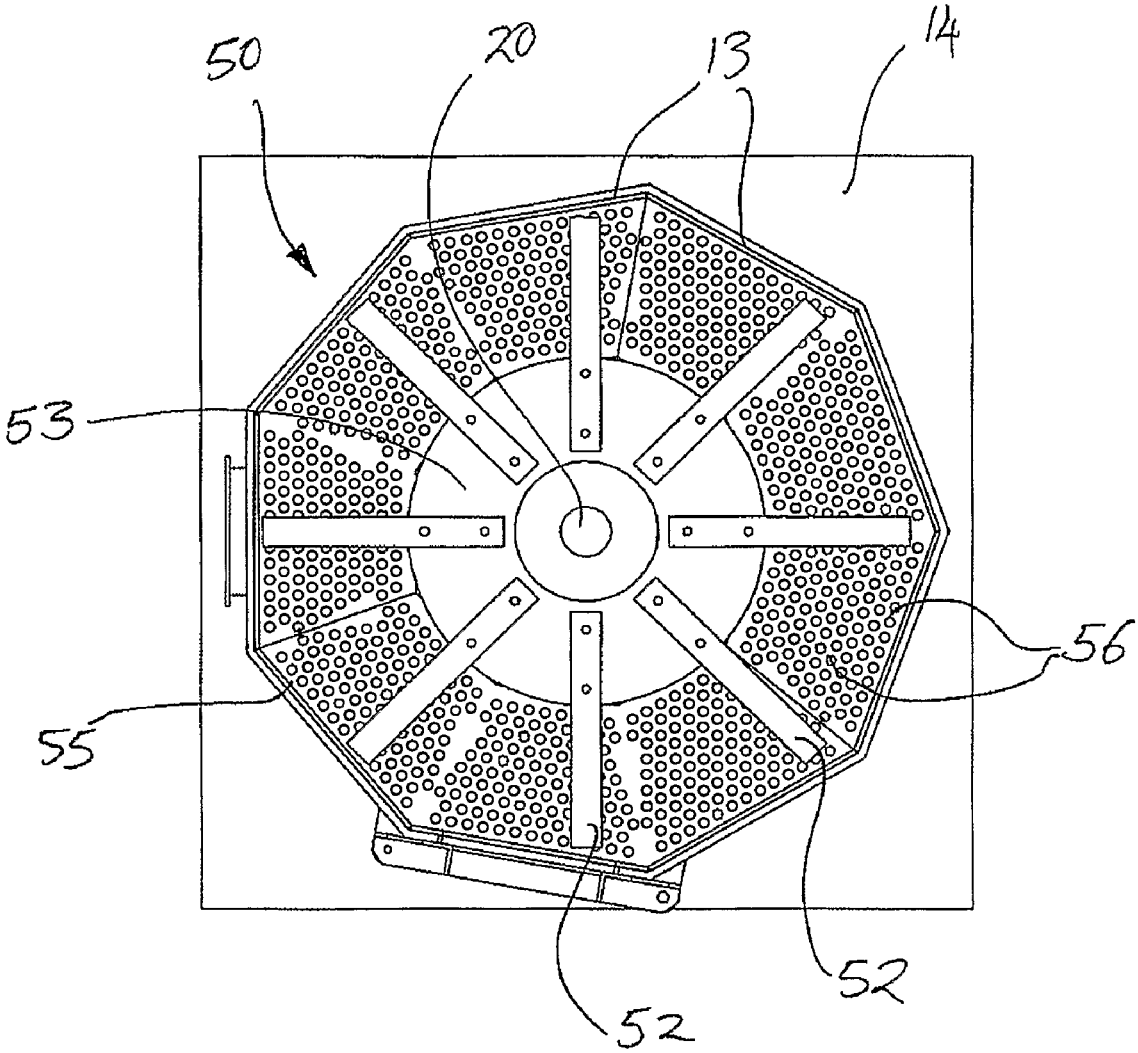

At the first stage 30, which is the uppermost stage in the housing, and is best shown in FIG. 5(*a*), the beater assembly comprises a beater plate 33 having a large diameter covering a large proportion of the housing's cross-sectional area. In the embodiment shown the beater plate 33 supports eight short beaters 32, although the number of beaters may vary depending on requirement. Beater plate 33 and beaters 32 rotate close to and spaced above the separation platform, which at the first stage is a shelf 34 having a large variable aperture 35. Shelf 34 extends across the entire interior of housing.

Aperture 35 has substantially the same diameter as beater plate 33 such that particulate material flows from the first stage to the second stage through the gap 36 between beater plate 33 and shelf 34. As beater plate 33 rotates around, beaters 32 cut and impact into the circulating particulate material reducing the size of particles in preparation for the next stage. As an example, whole sheets of newspaper introduced into the particulate reduction device is impacted at the first stage 30 preferably reducing the newspaper to about 10 $cm^2$, although this size can vary depending on the size of gap 36.

The second particle separation stage 40 is shown in FIG. 5(*b*) and is located below the first stage 30 and approximately midway down the housing interior. The beater assembly at the second stage comprises eight long beaters 42 supported on a beater plate 43 mounted to shaft 20. Second beater plate 43 is smaller in diameter than the beater plate 33 of the first stage with long beaters 42 extending further out from the second beater plate 43 than the short beaters 33 of the first stage. Long beaters 42 extend close to the interior wall of housing 12.

The separation platform at the second stage is a first perforated screen located directly beneath the beater assembly. The screen 45 extends across the whole interior of the housing and contains specifically and uniformly sized perforations 46 such that particulate matter can only pass through the perforations in order to reach the next stage and to exit. It follows that material flowing through the device can only pass through the first screen 45 if the material particles are the same size or smaller than the size of the perforations.

Long beaters 42 rotate about central shaft 20 impacting, cutting and grinding particulate material from the first stage down to a size that will allow the particles to pass through the perforations in the first screen 45. Together with the circumferential movement of the particles around the housing interior, the beaters break or beat against the particulate material causing the material to grind and move over the screen surface and abrade until the material passes through the perforations.

Having passed through the first screen in the second stage of particle reduction, the particulate material continues to flow down, under gravitational flow, centrifugal flow and/or suction, to the third stage 50, which in the embodiment shown is the final stage of particle reduction.

The third stage 50, shown in FIG. 5(*c*), is similar to the second stage 40 in that it includes a beater assembly with long beaters 52 supported on a small beater plate 53 adapted to rotate above a second screen 55. Second screen 55 constitutes the separation platform in the third stage and extends across the interior of the housing. Second screen 55 contains a number of small perforations 56 that are smaller in size than the larger perforations 46 in the first screen. The size of particles flowing through the third stage 50 is reduced by long beaters 52 and their passage regulated by the smaller perforations.

Figure 6:
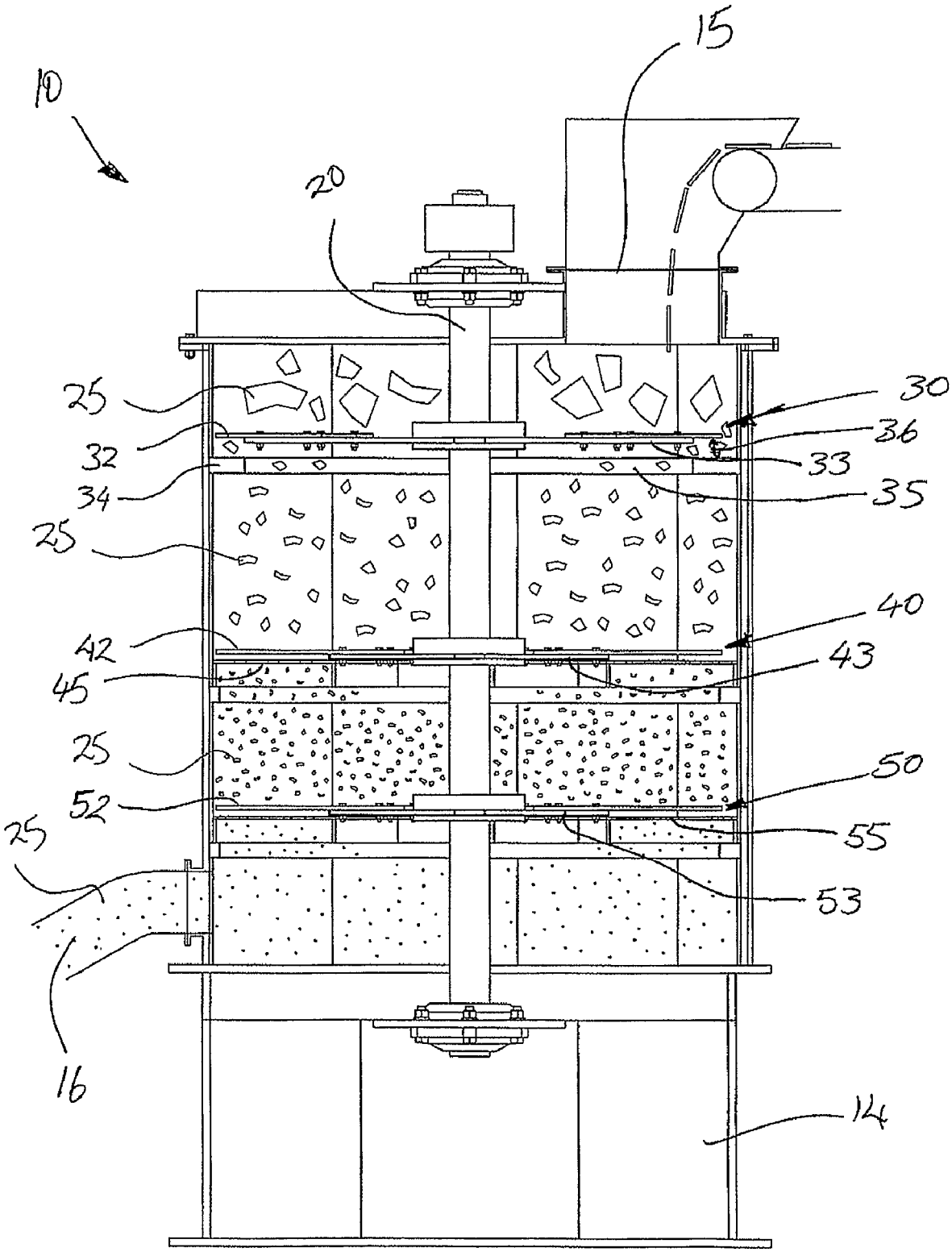
FIG. 6 is a side sectional view of the particle reduction device in operation.

After passing through the third stage 50 the particles are at their desired reduced size and are carried through to the outlets where the particulate material is evacuated. FIG. 6 illustrates the reduction process of particulate material 25 down through the three stages.

Three particle reduction stages are described herein, although it is understood that the principle of the device may be incorporated into a device with only two stages, of which only one need incorporate a beater/perforated screen assembly. Similarly, more than three stages may be used in a device where it may be appropriate to spread the particle reduction process over more screen passes.

The size of the perforations 46, 56 is chosen dependent on the size of material introduced into the device and on the desired size exiting the device. For instance, with paper in the form of newspaper, the particle reduction device will reduce whole newspaper into small fibrous matter.

In choosing perforation size, consideration is also given to the amount of resistance created by the screens in the flow rate of material through device 10. To prevent overfeeding of the third stage which can lead to bottlenecking and strain on the device, the third stage flow rate of material should be of a higher capacity than that of the second stage. This may be achieved by having a greater number of small perforations 56 in the second screen 55 having a collective area greater than the collective area of the perforations 46 in the first screen.

The multi-faceted nature of the housing walls, and hence housing interior, promotes particle circulation throughout the flow chamber 22 to avoid the build up of particulate material that may occur on the circumference of a cylindrical chamber.

Particle reduction device 10 operates under gravitational flow, the rotation of the beater assemblies causing centrifugal circulation to encourage flow. Particle flow through the flow chamber may be fan assisted to draw particles down through the device.

In the preferred embodiment the particle reduction stages are described as being one above the other. It is however feasible that the reduction stages be aligned horizontally, or otherwise, provided flow assistance such as by fans are used to assist in guiding the particle flow path.

The particle reduction device 10 provides an efficient means for reducing the size of particles by using a single device. Because no other device is required in tandem, the process of reducing material to a smaller size with the present device is more energy and cost efficient, and fewer parts leads to less machine maintenance.

It will be understood to persons skilled in the art of the invention that many modifications may be made without departing from the spirit and scope of the invention.

The claims defining the invention are as follows:

1. A paper particle reduction device comprising:

a housing containing an inlet for receiving material into a flow chamber, at least two adjacently and vertically spaced particle reduction stages through which material flows from one stage to the other for reducing the particle size of the material, and an outlet for outputting processed material with reduced particle size;

each particle reduction stage having an impact member that rotates about a vertical central shaft for impacting material into smaller particles, wherein at least one of the stages has a screen located downstream from the impact member, the screen having perforations through which particles of a sufficiently small size can pass, and the impact member comprising elongated beaters supported on, and extending radially from, a beater plate mounted to the central shaft; and wherein the housing has a multi-faceted interior wall.

2. The paper particle reduction device of claim 1, further comprising a fan to induce air flow and assist or draw material through the particle reduction stages.

3. The paper particle reduction device of claim 1, wherein the perforated screen is located in the last particle reduction stage before the outlet.

4. The paper particle reduction device of claim 1, wherein there are at least three particle reduction stages, the last two stages both having a perforated screen where the size of the perforations in the third stage screen are smaller than the perforations in the second stage screen.

5. The paper particle reduction device of claim 4, wherein the perforations of one screen total a flow area that is greater than the flow area totalled by the perforations in a preceding screen.

6. The paper particle reduction device of claim 1, wherein at a first stage the impact member is located above a shelf containing one large aperture, the impact member rotating close to the aperture's circumference on the shelf.

7. The paper particle reduction device of claim 6, wherein the impact member at the first stage is a solid rotor set to rotate around the central shaft and having short beaters provided about the circumference the solid rotor.

8. The paper particle reduction device of claim 1, wherein the elongated beaters are flat and extend close to the interior wall of the housing.

9. The paper particle reduction device of claim 1, wherein, each beater plate supports between four to ten beaters.

10. The paper particle reduction device of claim 1, wherein the housing is a nonagon in shape.

11. A method of reducing the particle size of paper material including:

introducing paper material into a particle reduction device comprising at least two adjacently and vertically spaced stages for reducing particle size;

impacting material with an impact member at each stage as the material flows through the device to reduce the material particle size at each stage, the impact member comprising elongated beaters supported on, and extending radially from, a beater plate mounted on a vertical central shaft;

wherein at least one of the stages impacts paper material in a multi-faceted housing interior until the material is reduced to fibers of a sufficiently small size to pass through a perforated screen located downstream of the impact member; and conveying the paper fibers with reduced particle size out of the device.

12. The method of claim 11 further comprising using induced air to assist conveying material through the stages.

13. The method of claim 11, including conveying the material through three particle reduction stages whereby the particle size of the material reduces at each stage.

14. The method of claim 13, including impacting the material at the last two stages until it is of a sufficiently small size to pass through perforated screens at the last two stages, the perforations of the last screen being smaller than the perforations of the second last screen.

* * * * *